US008466767B2

(12) United States Patent
Piascik et al.

(10) Patent No.: US 8,466,767 B2
(45) Date of Patent: Jun. 18, 2013

(54) ELECTROMAGNETIC COIL ASSEMBLIES HAVING TAPERED CRIMP JOINTS AND METHODS FOR THE PRODUCTION THEREOF

(75) Inventors: James Piascik, Randolph, NJ (US); Eric Passman, Piscataway, NJ (US); Robert Franconi, New Hartford, CT (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 13/187,359

(22) Filed: Jul. 20, 2011

(65) Prior Publication Data

US 2013/0021125 A1 Jan. 24, 2013

(51) Int. Cl.
*H01F 27/29* (2006.01)

(52) U.S. Cl.
USPC ..... 336/192

(58) Field of Classification Search
USPC ..... 336/65, 192, 107, 90, 96, 206–208
See application file for complete search history.

(56) References Cited

U.S. PATENT DOCUMENTS

| | | | | |
|---|---|---|---|---|
| 1,722,362 | A | | 7/1929 | Wiley |
| 1,742,018 | A | | 12/1929 | Wermine |
| 2,262,802 | A | | 11/1941 | Hayden |
| 2,787,769 | A | | 4/1957 | Hill et al. |
| 2,848,794 | A | | 8/1958 | Roth |
| 2,879,361 | A | | 3/1959 | Haynman |
| 2,904,619 | A | | 9/1959 | Fomey, Jr. |
| 2,944,235 | A | | 7/1960 | Peters |
| 2,997,647 | A | | 8/1961 | Gaugler et al. |
| 3,223,553 | A | | 12/1965 | Morey |
| 3,256,417 | A | | 6/1966 | Merrett |
| 3,308,411 | A | | 3/1967 | Roshala |
| 3,308,414 | A | | 3/1967 | Ostrander et al. |
| 3,352,009 | A | | 11/1967 | Cohn et al. |
| 3,373,390 | A | | 3/1968 | Rechel |
| 3,542,276 | A | * | 11/1970 | James ..... 228/2.5 |
| 3,688,397 | A | | 9/1972 | Cleaver et al. |
| 3,694,785 | A | | 9/1972 | Chass |

(Continued)

FOREIGN PATENT DOCUMENTS

| | | | |
|---|---|---|---|
| CN | 1174814 | C | 11/2004 |
| DE | 3830740 | A1 | 3/1990 |

(Continued)

OTHER PUBLICATIONS

R. F. Brazier, "Cables for aircraft. Pressure-type connections." Proceedings of the Institution of Electrical Engineers, Jan. 1, 1967, p. 1307, vol. 114, No. 9.

(Continued)

*Primary Examiner* — Tuyen Nguyen
(74) *Attorney, Agent, or Firm* — Ingrassia Fisher & Lorenz, P.C.

(57) ABSTRACT

Embodiments of an electromagnetic coil assembly are provided, as are embodiments of producing an electromagnetic coil assembly. In one embodiment, the electromagnetic coil assembly includes a coiled magnet wire, an inorganic electrically-insulative body encapsulating at least a portion of the coiled magnet wire, a lead wire extending into the inorganic electrically-insulative body to the coiled magnet wire, and a first tapered crimp joint embedded within the inorganic electrically-insulative body. The first tapered crimp joint mechanically and electrically connects the lead wire to the coiled magnet wire.

18 Claims, 6 Drawing Sheets

U.S. PATENT DOCUMENTS

| | | | | |
|---|---|---|---|---|
| 3,731,368 | A | | 5/1973 | Dieteman et al. |
| 3,812,580 | A | | 5/1974 | Drugmand |
| 3,862,416 | A | | 1/1975 | Phillips et al. |
| 3,881,163 | A | | 4/1975 | Lindroth et al. |
| 4,056,883 | A | | 11/1977 | Danner |
| 4,057,187 | A | * | 11/1977 | Cranston et al. ..... 228/107 |
| 4,107,635 | A | | 8/1978 | Brundage et al. |
| 4,135,296 | A | | 1/1979 | Kami et al. |
| 4,196,510 | A | | 4/1980 | Gudmestad et al. |
| 4,388,371 | A | | 6/1983 | Bolon et al. |
| 4,429,007 | A | | 1/1984 | Bich et al. |
| 4,445,103 | A | | 4/1984 | Chass |
| 4,476,192 | A | | 10/1984 | Imai et al. |
| 4,524,624 | A | | 6/1985 | Di Noia et al. |
| 4,554,730 | A | | 11/1985 | Westervelt et al. |
| 4,621,251 | A | | 11/1986 | Keefe |
| 4,641,911 | A | | 2/1987 | Pavlak et al. |
| 4,786,760 | A | | 11/1988 | Friedhelm |
| 4,866,573 | A | | 9/1989 | Bernstein |
| 4,870,308 | A | | 9/1989 | Sismour, Jr. |
| 5,091,609 | A | | 2/1992 | Sawada et al. |
| 5,105,531 | A | | 4/1992 | Sawada et al. |
| 5,140,292 | A | | 8/1992 | Aronow |
| 5,211,789 | A | | 5/1993 | Christian et al. |
| 5,226,220 | A | | 7/1993 | Gevas et al. |
| 5,493,159 | A | | 2/1996 | Norris |
| 5,497,936 | A | | 3/1996 | Vojta et al. |
| 5,636,434 | A | | 6/1997 | Okey et al. |
| 5,666,099 | A | | 9/1997 | Ostrem |
| 5,675,891 | A | | 10/1997 | Childs et al. |
| 5,693,208 | A | | 12/1997 | Paulet |
| 5,815,091 | A | | 9/1998 | Dames et al. |
| 5,833,825 | A | | 11/1998 | Otten et al. |
| 6,009,141 | A | | 12/1999 | Hell et al. |
| 6,038,760 | A | | 3/2000 | Antoine et al. |
| 6,189,202 | B1 | | 2/2001 | Masuda et al. |
| 6,261,437 | B1 | | 7/2001 | Hernnaes et al. |
| 6,368,485 | B1 | | 4/2002 | Ue et al. |
| 6,750,749 | B2 | | 6/2004 | Shirahata et al. |
| 6,909,279 | B2 | | 6/2005 | Niwa |
| 6,927,666 | B2 | | 8/2005 | Ahn et al. |
| 6,976,308 | B2 | | 12/2005 | Jonli |
| 7,129,605 | B2 | | 10/2006 | Zhang et al. |
| 7,147,500 | B2 | | 12/2006 | Tabata et al. |
| 7,365,627 | B2 | | 4/2008 | Yen et al. |
| 7,394,022 | B2 | | 7/2008 | Gumley |
| 7,572,980 | B2 | | 8/2009 | Elie et al. |
| 7,588,530 | B2 | | 9/2009 | Heilman et al. |
| 7,705,265 | B2 | | 4/2010 | Asakura et al. |
| 7,795,538 | B2 | | 9/2010 | Kaiser et al. |
| 7,947,905 | B2 | | 5/2011 | Pasini |
| 8,128,441 | B2 | | 3/2012 | Mukuno |
| 2003/0010813 | A1 | | 1/2003 | Nakaya |
| 2003/0020344 | A1 | | 1/2003 | Futami et al. |
| 2004/0140293 | A1 | | 7/2004 | Kohama et al. |
| 2004/0158981 | A1 | | 8/2004 | Antaya et al. |
| 2005/0012423 | A1 | | 1/2005 | Yasuhara et al. |
| 2007/0279047 | A1 | | 12/2007 | Schumacher |
| 2009/0206974 | A1 | | 8/2009 | Meinke |
| 2009/0255319 | A1 | | 10/2009 | Sokol |
| 2009/0325809 | A1 | | 12/2009 | Hong et al. |
| 2010/0018768 | A1 | | 1/2010 | Takahashi et al. |
| 2010/0031497 | A1 | | 2/2010 | Saka et al. |
| 2010/0176683 | A1 | | 7/2010 | Waddell et al. |
| 2010/0189884 | A1 | | 7/2010 | Kaiser et al. |
| 2011/0054584 | A1 | | 3/2011 | Alexander et al. |
| 2011/0192451 | A1 | | 8/2011 | Sato et al. |

FOREIGN PATENT DOCUMENTS

| | | | |
|---|---|---|---|
| DE | 102010001888 | A1 | 8/2010 |
| EP | 0012422 | A1 | 6/1980 |
| GB | 719126 | A | 11/1954 |
| JP | 2005183554 | A | 7/2005 |
| JP | 2008288512 | A | 11/2008 |

OTHER PUBLICATIONS

EPO, European Extended Search Report for Application No. 12175199.4, dated Oct. 17, 2012.

Chaklader, et al.; Alumina fibre from aluminium wire, ScienceDirect.com—Composites—Alumina fibre from aluminium wire; retrieved from Internet http://www.sciencedirect.com/science/article/pii/0010436181900173.

* cited by examiner

ELECTROMAGNETIC COIL ASSEMBLIES HAVING TAPERED CRIMP JOINTS AND METHODS FOR THE PRODUCTION THEREOF

TECHNICAL FIELD

The present invention relates generally to coiled-wire devices and, more particularly, to electromagnetic coil assemblies having tapered crimp joints well-suited for usage within high temperature operating environments, as well as to methods for the production of electromagnetic coil assemblies.

BACKGROUND

There is an ongoing demand in the aerospace and industrial industry for low cost electromagnetic coil assemblies suitable for usage in coiled-wire devices, such as actuators (e.g., solenoids) and sensors (e.g., variable differential transformers), capable of providing prolonged and reliable operation in high temperature environments characterized by temperatures exceeding 260° C. and, preferably, in high temperature environments characterized by temperatures approaching or exceeding 400° C. In general, an electromagnetic coil assembly includes at least one magnet wire, which is wound around a bobbin or similar support structure to produce at least one multi-turn coil. When designed for usage within a solenoid, the electromagnetic coil assembly often includes a single coil; while, when utilized within a variable differential transformer, the electromagnetic coil assembly typically includes a primary coil and two or more secondary coils. To provide mechanical isolation, position holding, and electrical insulation between neighboring turns, the wire coil or coils may be potted in a body of insulative material (referred to herein as an "electrically-insulative body"). The opposing ends of the wire coil or coils are fed through the electrically-insulative body for electrical connection to, for example, feedthroughs mounted through the device housing. In the case of a conventional, non-high temperature electromagnetic coil assembly, the insulative body is commonly formed from a plastic or other readily-available organic dielectric material. Organic materials, however, rapidly decompose, become brittle, and ultimately fail when subjected to temperatures exceeding approximately 260° C.; and are consequently unsuitable for usage within high temperature electromagnetic coil assemblies of the type described above. Organic insulative materials also tend to be relatively sensitive to radiation and are consequently less well-suited for usage within the nuclear industry.

Considering the above, it would be desirable to provide embodiments of an electromagnetic coil assembly for usage within coiled-wire devices (e.g., solenoids, variable differential transformers, and two position sensors, to list but a few) suitable for operating in high temperature environments characterized by temperatures exceeding 260° C. and, preferably, approaching or exceeding approximately 400° C. Ideally, embodiments of such an electromagnet coil assembly would be relatively insensitive to radiation and well-suited for usage within nuclear applications. It would also be desirable to provide embodiments of a method for manufacture such a high temperature electromagnetic coil assembly. Other desirable features and characteristics of the present invention will become apparent from the subsequent Detailed Description and the appended claims, taken in conjunction with the accompanying Drawings and the foregoing Background.

BRIEF SUMMARY

Embodiments of an electromagnetic coil assembly are provided. In one embodiment, the electromagnetic coil assembly includes a coiled magnet wire, an inorganic electrically-insulative body encapsulating at least a portion of the coiled magnet wire, a lead wire extending into the inorganic electrically-insulative body to the coiled magnet wire, and a first tapered crimp joint embedded within the inorganic electrically-insulative body. The first tapered crimp joint mechanically and electrically connects the lead wire to the coiled magnet wire.

Embodiments of a method are further provided for producing an electromagnet coil assembly. In one embodiment, the method includes the steps of forming an inorganic electrically-insulative body in which at least one magnet wire coil is embedded, and forming tapered crimp joint connecting an end portion of the magnet wire coil to a lead wire such that the tapered crimp joint is buried within the inorganic electrically-insulative body.

BRIEF DESCRIPTION OF THE DRAWINGS

At least one example of the present invention will hereinafter be described in conjunction with the following figures, wherein like numerals denote like elements, and.

DETAILED DESCRIPTION

The following Detailed Description is merely exemplary in nature and is not intended to limit the invention or the application and uses of the invention. Furthermore, there is no intention to be bound by any theory presented in the preceding Background or the following Detailed Description.

As noted in the foregoing section entitled "BACKGROUND," in the case of conventional, non-high temperature electromagnetic coil assemblies, the magnet wire coil or coils are typically potted within an insulative body formed from an organic material, such as a plastic, which fail when subjected to temperatures exceeding approximately 260° C. To increase operating temperature capabilities of the electromagnetic coil assembly, the insulative body in which magnet wire coil or coils are potted can be formed from an inorganic dielectric material, such as a ceramic or inorganic cement. However, such inorganic insulative materials tend to be highly rigid and inflexible; and, as a result, effectively fix into place the sections of the magnet wire or wires protruding from the rigid inorganic insulative body. As the magnet wire or wires are manipulated during assembly manufacture, the segments of the magnet wire protruding from the insulative medium are subjected to bending and pulling forces concentrated at the wire's entry point into or exit point from the insulative medium. If bent or otherwise manipulated excessively, the segments of the magnet wire protruding from the insulative medium may consequently become overly-stressed and work harden. Work hardening may result in breakage of the magnet wire during assembly or the creation of a high resistance "hot spot" within the magnet wire accelerating open circuit failure during operation of the electromagnetic coil assembly. Work hardening and breakage is especially problematic in the case of electromagnetic coil assembly including fine gauge magnet wires and/or magnet wires formed from metals prone to mechanical fatigue, such as aluminum. To address this issue, embodiments of an electromagnetic coil assembly are provided herein wherein the application of mechanical stress and work hardening of the coiled magnet wire or wires included within the coil assembly is avoided during manufacture of the coil assembly.

Figure 1:
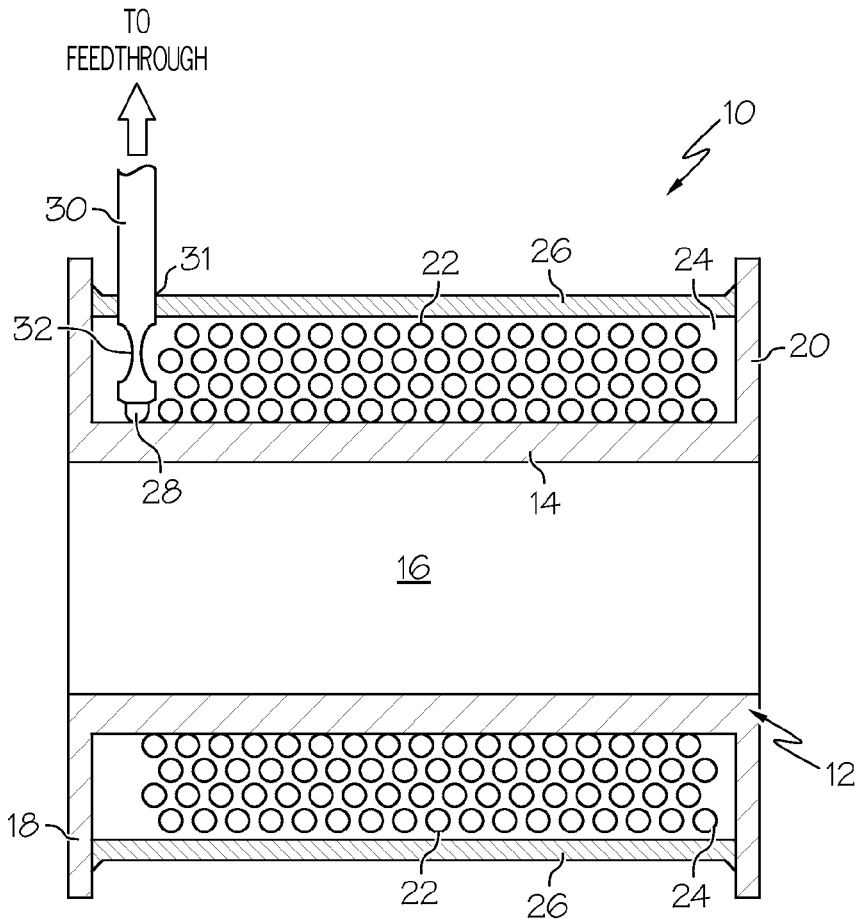
FIG. 1 is a cross-sectional view of an electromagnetic coil assembly including a coiled magnet wire and a lead wire joined by way of a tapered crimp joint and illustrated in accordance with an exemplary embodiment of the present invention.

FIG. 1 is a cross-sectional view of an electromagnetic coil assembly 10 illustrated in accordance with an exemplary embodiment of the present invention. Electromagnetic coil assembly 10 is suitable for usage within high temperature operating environments characterized by temperatures exceeding the threshold at which organic materials breakdown and decompose (approximately 260° C.) and, in preferred embodiments, characterized by temperatures approaching or exceeding 400° C. In view of its high temperature capabilities, electromagnetic coil assembly 10 is well-suited for usage in high temperature coiled-wire devices, such as those utilized in avionic applications. More specifically, and by way of non-limiting example, embodiments of high temperature electromagnetic coil assembly 10 are well-suited for usage within actuators (e.g., solenoids) and position sensors (e.g., variable differential transformers and two position sensors) deployed onboard aircraft. This notwithstanding, it is emphasized that embodiments of electromagnetic coil assembly 10 can be employed in any coiled-wire device, regardless of the particular form assumed by the coiled-wire device or the particular application in which the coiled-wire device is utilized.

Electromagnetic coil assembly 10 includes a support structure around which at least one magnet wire is wound to produce one or more electromagnetic coils. In the illustrated example, the support structure assumes the form of a hollow spool or bobbin 12 having an elongated tubular body 14, a central channel 16 extending through tubular body 14, and first and second flanges 18 and 20 extending radially outward from first and second opposing ends of body 14, respectively. Although not shown in FIG. 1 for clarity, an outer insulative shell may be formed over the outer surface of bobbin 12 or an outer insulative coating may be deposited over the outer surface of bobbin 12 to provide electrical insulation between wire coil 22 (described below) and bobbin 12. For example, in embodiments wherein bobbin 12 is fabricated from a stainless steel, bobbin 12 may be coated with an outer dielectric material utilizing, for example, a brushing or spraying process. In one embodiment, a glass may be brushed onto bobbin 12 as a paste or paint, dried, and then fired to form an electrically-insulative coating over selected areas of bobbin 12. As a second example, in embodiments wherein electromagnetic coil assembly 10 is disposed within a hermetic package, an electrically-insulative inorganic cement of the type described below may also be applied over the outer surfaces of bobbin 12 and cured to produce the electrically-insulative coating and thereby provide a breakdown voltage standoff. As a still further possibility, in embodiments wherein bobbin 12 is fabricated from an aluminum, bobbin 12 may be anodized to form an insulative alumina shell over the outer surface of bobbin 12. Bobbin 12 is preferably fabricated from a substantially non-ferromagnetic material, such as aluminum, a non-ferromagnetic 300 series stainless steel, or a ceramic.

As noted above, at least one magnet wire is wound around bobbin 12 to form one or more magnet wire coils. In the illustrated example, a single magnet wire is wound around tubular body 14 of bobbin 12 to produce a multi-turn, multi-layer coiled magnet wire 22. The magnet wire may be wound around bobbin 12 utilizing a conventional wire winding machine. In a preferred embodiment, coiled magnet wire 22 assumes the form of anodized aluminum wire; that is, aluminum wire that has been anodized to form an insulative shell of aluminum oxide over the wire's outer surface. Advantageously, aluminum wire provides excellent conductivity enabling the dimensions and overall weight of high temperature electromagnetic coil assembly 10 to be reduced, which is especially desirable in the context of avionic applications. In addition, the outer alumina shell of anodized aluminum wire provides additional electrical insulation between neighboring turns of coiled magnet wire 22 and between wire 22 and bobbin 12 to further reduce the likelihood of shorting and breakdown voltage during operation of high temperature electromagnetic coil assembly 10. As a still further advantage, anodized aluminum wire is readily commercially available at minimal cost.

An electrically-insulative inorganic body 24 is formed around tubular body 14 and between flanges 18 and 20 of bobbin 12. Stated differently, the annular volume of space defined by the outer circumferential surface of tubular body 14 and the inner radial faces of flanges 18 and 20 is at least partially potted with an inorganic dielectric material or medium to form electrically-insulative body 24. Coiled magnet wire 22 is at least partially encapsulated within electrically-insulative body 24 and, preferably, wholly embedded therein. Electrically-insulative body 24 provides mechanical isolation, position holding, and electrical insulation between neighboring turns of coiled magnet wire 22 through the operative temperature range of the electromagnetic coil assembly 10. Electrically-insulative inorganic body 24 is preferably formed from a ceramic medium or material; i.e., an inorganic and non-metallic material, whether crystalline or amorphous. Furthermore, in embodiments wherein coiled magnet wire 22 is produced utilizing anodized aluminum wire, electrically-insulative inorganic body 24 is preferably formed from a material having a coefficient of thermal expansion ("CTE") approaching that of aluminum (approximately 23 parts per million per degree Celsius), but preferably not exceeding the CTE of aluminum, to minimize the mechanical stress applied to the anodized aluminum wire during thermal cycling. Thus, in embodiments wherein coiled magnet wire 22 is produced from anodized aluminum wire, electrically-insulative body 24 is preferably formed to have a CTE exceeding approximately 10 parts per million per degree Celsius ("ppm per ° C.") and, more preferably, a CTE between approximately 16 and approximately 23 ppm per ° C. Suitable materials include inorganic cements, and certain low melt glasses (i.e., glasses or glass mixtures having a melting point less than the melting point of anodized aluminum wire), such as leaded borosilicate glasses. As a still more specific example, electrically-insulative inorganic body 24 may be produced from a water-activated, silicate-based cement, such as the sealing cement bearing Product No. 33S and commercially available from the SAUEREISEN® Cements Company, Inc., headquartered in Pittsburgh, Pa.

Electrically-insulative inorganic body 24 can be formed in a variety of different manners. In preferred embodiments, electrically-insulative body 24 is formed utilizing a wet-winding process. During wet-winding, the magnet wire is wound around bobbin 12 while an inorganic dielectric material is applied over the wire's outer surface in a wet or flowable state to form a viscous coating thereon. The phrase "wet-state," as appearing herein, denotes a ceramic or other inorganic material carried by (e.g., dissolved within) or containing a sufficient quantity of liquid to be applied over the magnet wire in real-time during a wet winding process by brushing, spraying, or similar technique. For example, in the wet-state, the ceramic material may assume the form of a pre-cure (e.g., water-activated) cement or a plurality of ceramic (e.g., low melt glass) particles dissolved in a solvent, such as a high molecular weight alcohol, to form a slurry or paste. The selected dielectric material may be continually applied over the full width of the magnet wire to the entry point of the coil such that the puddle of liquid is formed through which the existing wire coils continually pass. The magnet wire may be slowly turned during application of the dielectric material by, for example, a rotating apparatus or wire winding machine, and a relatively thick layer of the dielectric material may be continually brushed onto the wire's surface to ensure that a sufficient quantity of the material is present to fill the space between neighboring turns and multiple layers of coiled magnet wire 22. In large scale production, application of the selected dielectric material to the magnet wire may be performed utilizing a pad, brush, or automated dispenser, which dispenses a controlled amount of the dielectric material over the wire during winding.

As noted above, electrically-insulative body 24 can be fabricated from a mixture of at least a low melt glass and a particulate filler material. Low melt glasses having coefficients of thermal expansion exceeding approximately 10 ppm per ° C. include, but are not limited to, leaded borosilicates glasses. Commercially available leaded borosilicate glasses include 5635, 5642, and 5650 series glasses having processing temperatures ranging from approximately 350° C. to approximately 550° C. and available from KOARTAN™ Microelectronic Interconnect Materials, Inc., headquartered in Randolph, N.J. The low melt glass is conveniently applied as a paste or slurry, which may be formulated from ground particles of the low melt glass, the particulate filler material, a solvent, and a binder. In a preferred embodiment, the solvent is a high molecular weight alcohol resistant to evaporation at room temperature, such as alpha-terpineol or TEXINOL®; and the binder is ethyl cellulose, an acrylic, or similar material. It is desirable to include a particulate filler material in the embodiments wherein the electrically-insulative, inorganic material comprises a low melt glass to prevent relevant movement and physical contact between neighboring coils of the anodized aluminum wire during coiling and firing processes. Although the filler material may comprise any particulate material suitable for this purpose (e.g., zirconium or aluminum powder), binder materials having particles generally characterized by thin, sheet-like shapes (commonly referred to as "platelets" or "laminae") have been found to better maintain relative positioning between neighboring coils as such particles are less likely to dislodge from between two adjacent turns or layers of the wire's cured outer surface than are spherical particles. Examples of suitable binder materials having thin, sheet-like particles include mica and vermiculite. As indicated above, the low melt glass may be applied to the magnet wire by brushing immediately prior to the location at which the wire is coiled around the support structure.

After performance of the above-described wet-winding process, the green state dielectric material is cured to transform electrically-insulative inorganic body 24 into a solid state. As appearing herein, the term "curing" denotes exposing the wet-state, dielectric material to process conditions (e.g., temperatures) sufficient to transform the material into a solid dielectric medium or body, whether by chemical reaction or by melting of particles. The term "curing" is thus defined to include firing of, for example, low melt glasses. In most cases, curing of the chosen dielectric material will involve thermal cycling over a relatively wide temperature range, which will typically entail exposure to elevated temperatures well exceeding room temperatures (e.g., about 20-25° C.), but less than the melting point of the magnet wire (e.g., in the case of anodized aluminum wire, approximately 660° C.). However, in embodiments wherein the chosen dielectric material is an inorganic cement curable at or near room temperature, curing may be performed, at least in part, at correspondingly low temperatures. For example, if the chosen dielectric material is an inorganic cement, partial curing may be performed at a first temperature slightly above room temperature (e.g., at approximately 82° C.) to drive out moisture before further curing is performed at higher temperatures exceeding the boiling point of water. In preferred embodiments, curing is performed at temperatures up to the expected operating temperatures of high temperature electromagnetic coil assembly 10, which may approach or exceed approximately 315° C. In embodiments wherein coiled magnet wire 22 is produced utilizing anodized aluminum wire, it is also preferred that the curing temperature exceeds the annealing temperature of aluminum (e.g., approximately 340° C. to 415° C., depending upon wire composition) to relieve any mechanical stress within the aluminum wire created during the crimping process described below. High temperature curing may also form aluminum oxide over any exposed areas of the anodized aluminum wire created by abrasion during winding to further reduces the likelihood of shorting.

In embodiments wherein electrically-insulative inorganic body 24 is formed from a material susceptible to water intake, such as a porous inorganic cement, it is desirable to prevent the ingress of water into body 24. As will be described more fully below, electromagnetic coil assembly 10 may further include a container, such as a generally cylindrical canister, in which bobbin 12, electrically-insulative body 24, and coiled magnet wire 22 are hermetically sealed. In such cases, the ingress of moisture into the hermetically-sealed container and the subsequent wicking of moisture into electrically-insulative body 24 is unlikely. However, if additional moisture protection is desired, a liquid sealant may be applied over an outer surface of electrically-insulative inorganic body 24 to encapsulate body 24, as indicated in FIG. 1 at 26. Sealants suitable for this purpose include, but are limited to, water-glass, silicone-based sealants (e.g., ceramic silicone), low melting (e.g., lead borosilicate) glass materials of the type described above. A sol-gel process can be utilized to deposit ceramic materials in particulate form over the outer surface of electrically-insulative inorganic body 24, which may be subsequently heated, allowed to cool, and solidify to form a dense water-impenetrable coating over electrically-insulative inorganic body 24.

To provide electrical connection to the electromagnetic coil embedded within dielectric inorganic body 24, lead wires are joined to opposing ends of coiled magnet wire 22. In accordance with embodiments of the present invention, at least one, and preferably both, of the opposing ends of coiled magnet wire 22 are joined to a lead wire by way of a tapered crimp joint. To further emphasize this point, FIG. 1 generically illustrates an end portion 28 of coiled magnet wire 22 joined to a neighboring end portion of a lead wire 30 (partially shown) by way of a tapered crimp joint 32. Notably, tapered crimp joint 32 is embedded or buried within electrically-insulative inorganic body 24. As a result, tapered crimp joint 32, and therefore end portion 28 of coiled magnet wire 22, are mechanically isolated from bending and pulling forces exerted on the external segments of lead wire 30. In embodiments wherein coiled magnet wire 22 is produced utilizing a fine gauge wire and/or an anodized aluminum wire prone to mechanical fatigue and work hardening, the application of strain and stress to coiled magnet wire 22 is consequently minimized and the development of high resistance hot spots within wire 22 is avoided. While depicted as projecting radially outward from coiled magnet wire 22 in FIG. 1 for clarity, tapered crimp joint 32 is preferably laid flat across coiled magnet wire 22 such that joint 32 extends adjacent to the outer surface of the potted coil along a substantially linear path, as described below in conjunction with FIGS. 8-12, or along a spiral path, as described more fully below in conjunction with FIG. 13. Although not shown in FIG. 1 for clarity, the opposing end portion of coiled magnet wire 22 may likewise be joined to a second lead wire utilizing a similar tapered crimp joint.

With continued reference to FIG. 1, lead wire 30 projects through the outer surface of electrically-insulative inorganic body 24 at an entry/exit point 31. The protruding segment of lead wire 30 will consequently be subjected to unavoidable mechanical forces (e.g., bending, twisting, pulling, etc.) at this interface due to manipulation of lead wire 30 during manufacture and assembly of electromagnetic coil assembly 10. However, relative to coiled magnet wire 22, lead wire 30 is able tolerate these forces without significant mechanical fatigue or work hardening for at least one of three reasons. First, lead wire 30 may be formed from a material (e.g., nickel or stainless steel) having a higher mechanical strength than does the material from which coiled magnet wire 22 is produced (e.g., anodized aluminum). Second, lead wire 30 may assume the form of a single conductor or non-braided wire having a diameter significantly larger than the wire diameter of coiled magnet wire 22; e.g., in certain embodiments, the diameter of lead wire 30 may be approximately 18-24 American Wire Gauge ("AWG"), while the wire diameter of coiled magnet wire 22 may be approximately 30-36 AWG. Third, in preferred embodiments, lead wire 30 assumes the form of a braided wire (i.e., a plurality of filaments or conductors woven into an elongated flexible cylinder or tube) having a high flexibility and, thus, capable of bending with relative ease to accommodate the physical manipulation of lead wire 30 during production and assembly of electromagnetic coil assembly 10. In this latter case, the diameter of the individual filaments or conductors woven together to form lead wire 30 may each have a diameter greater than or less than the wire diameter of coiled magnet wire 22. In embodiments wherein lead wire 30 assumes the form of a single, large diameter conductor or a braided wire, lead wire 30 is preferably formed from aluminum, although the possibility that lead wire 30 can be formed from other conductive materials (e.g., nickel or stainless steel) is by no means precluded.

Figure 2:
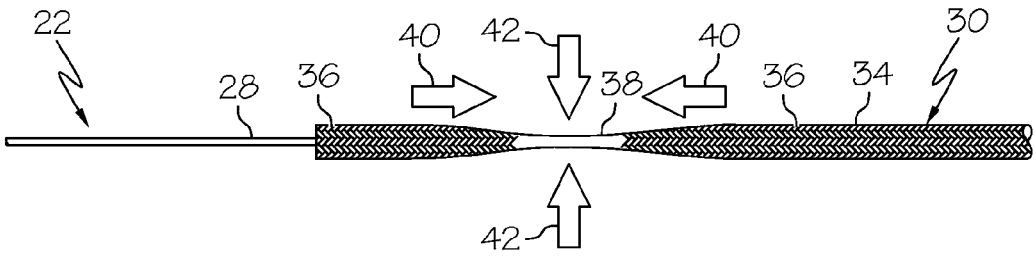
FIG. 2 is a side view of a first exemplary tapered crimp joint utilized to mechanically and electrically interconnect the magnet wire shown in FIG. 1 to a neighboring lead wire.

FIG. 2 is a side view illustrating, in greater detail, a first exemplary manner in which end portion 28 of coiled magnet wire 22 may be joined to a neighboring end portion 34 of lead wire 30 by way of a tapered crimp joint 32. In this particular example, lead wire 30 assumes the form of a hollow braided wire; that is, a plurality of filaments or individual conductors, which are woven together to form an elongated, flexible tube or cable. End portion 28 of coiled magnet wire 22 has been inserted into end portion 34 of braided lead wire 30 such that the penetrating segment of coiled magnet wire 22 extends within the receiving segment of braided lead wire 30 in coaxial relationship. After insertion of coiled magnet wire 22 into lead wire 30, lead wire 30 is subsequently crimped over coiled magnet wire 22 to form tapered crimp joint 32. Crimp joint 32 is considered "tapered" in that the deformation of joint 32 increases in a gradual, continuous, or non-stepped manner when moving axially along the length of joint 32. In the exemplary embodiment illustrated in FIG. 2, and as indicated by converging arrows 40, crimp joint 32 gradually increases in deformation when from opposing ends 36 of crimp joint 32 toward center portion 38 of joint 32. In forming tapered crimp joint 32, a deforming force is applied to opposing sides of end portion 34 of lead wire 30 into which coiled magnet wire 22 has previously been inserted. In this manner, the opposing crimped side of joint 32 are imparted with substantially arcuate or concave lateral profiles, when viewed in a direction substantially perpendicular to the direction of the convergent crimp; and crimp joint 32, taken in its entirety, is imparted with a substantially hourglass-shaped profile, when viewed from a side of the tapered crimp joint. The crimping process induces sufficient deformation through crimp joint 32 to ensure the creation of a metallurgical bond or cold weld between coiled magnet wire 22 and lead wire 30, as described more fully below.

An optimal mechanical bond is most readily achieved when braided lead wire 30 and coiled magnet wire 22 are crimped with a force sufficient to induce a moderate deformation of the wire-to-wire interface; however, moderate deformation of the crimp joint typically does not provide optimal electrical conductivity. Conversely, an optimal electrical bond is typically achieved when braided lead 30 and coiled wire 22 are crimped with a force sufficient to induce extensive deformation across the wire-to-wire interface; however, such a heavy or strong crimp tends to detract from the overall mechanical strength of the resulting crimp joint. Thus, by imparting crimp joint 32 with such a tapered or gradual deformation, such as the hourglass-shaped profile shown in FIG. 2, it can be ensured that both an optimal mechanical and an optimal electrical bond are formed along the length of crimp joint 32. The least deformed regions of tapered crimp joint 32 are preferably characterized by a deformation equivalent to or slightly less than the deformation required to form an optimal metallurgical bond between coiled magnet wire 22 and braided lead wire 30, while the most severely deformed regions of crimp joint 32 are preferably characterized by a deformation equivalent to or slightly greater than the deformation required to form an ideal electrical interface between wires 22 and 30.

As a point of emphasis, end portion 28 of coiled magnet wire 22 can be inserted directly into the main opening provided in either terminal end of the lead wire (shown in FIG. 2) or, instead, inserted into the sidewall of lead wire by threading the magnet wire between the woven conductors of the lead wire's end portion. In either case, the end portion of coiled magnet wire 22 is considered "inserted into" the neighboring end portion of braided lead wire 30 in the context of the present document. In embodiments wherein coiled magnet wire 22 is inserted through the woven sidewall of braided lead wire 30, coiled magnet wire 22 and braided lead wire 30 may extend from opposing ends of crimp joint 32 such that the wire-to-wire joinder interface has a substantially linear geometry. Alternatively, in embodiments wherein coiled magnet wire 22 is inserted through the annular sidewall of braided lead wire 30, coiled magnet wire 22 and braided lead wire 30 may extend from the same end of crimp joint 32 such that the wire-to-wire joinder interface has a substantially Y-shaped geometry. In this latter case, the terminal end of crimp joint from which wires 22 and 30 do not emerge may be trimmed after crimping to remove any excess therefrom. Three or more wires can also be mechanically and electrically connected utilizing such a joiner interface by inserting multiple wires through the woven sidewall of the braided lead wire and crimping the resulting structure in the manner described below. Braided lead wire 30 may also assume the form of a flat braid, in which case coiled magnet wire 22 may be inserted into the end portion of wire 30 by threading coiled magnet wire 22 through the woven filaments of wire 30, as previously described. In certain embodiments, coiled magnet wire 22 may be repeatedly threaded through the woven sidewall of braided lead wire 30 along an undulating path to effectively weave magnet wire 22 into lead wire 30.

Figure 3:
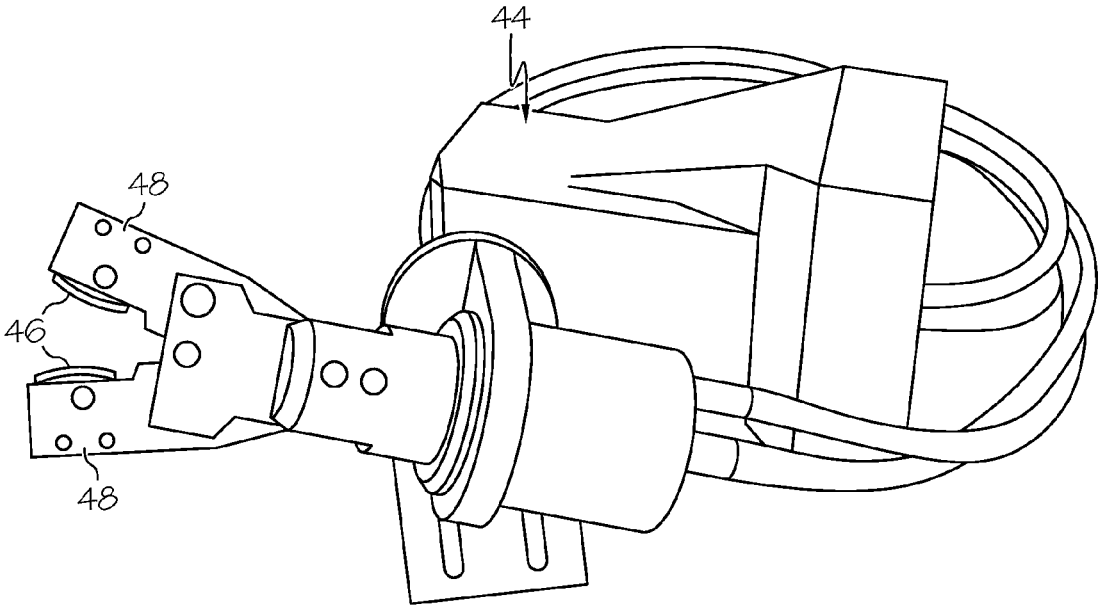
FIG. 3 is an isometric view of a crimping tool that may be utilized to form the tapered crimp joint shown in FIG. 2.

FIG. 3 is an isometric view of an industrial crimping tool 44 suitable for formation of tapered crimp joint 32. In this particular example, crimping tool 44 is a handheld pneumatic crimping tool, which may be utilized in conjunction with a fixture (not shown) to position coiled magnet wire 22 and braided lead wire 30 during the crimping process. As shown in FIG. 3, two crimp platens 46 are mounted to opposing jaws 48 of crimping tool 44. Crimp platens 46 each have convex shape, which increase gradually in width when moving longitudinally from either of the platen's edges toward the platen's center. Stated differently, the outer crimping surface of each crimp platen 46 may generally follow a substantially semi-circular or parabolic contour. After insertion of coiled magnet wire 22, end portion 34 of lead wire 30 is positioned between jaws 48 of crimping tool 44. Crimping tool 44 is then actuated, and platens 46 contact and compress end portion 34 of lead wire 30 around the inserted or penetrating portion of coiled magnet wire 22 thereby forming tapered crimp joint 32. Due to their respective convex geometries, platens 46 impart crimp joint 32 with the above-described tapered profile and thereby ensure that both optimal mechanical and electrical bonds are created between magnet wire 22 and lead wire 30 pursuant to the crimping process.

Figure 4:
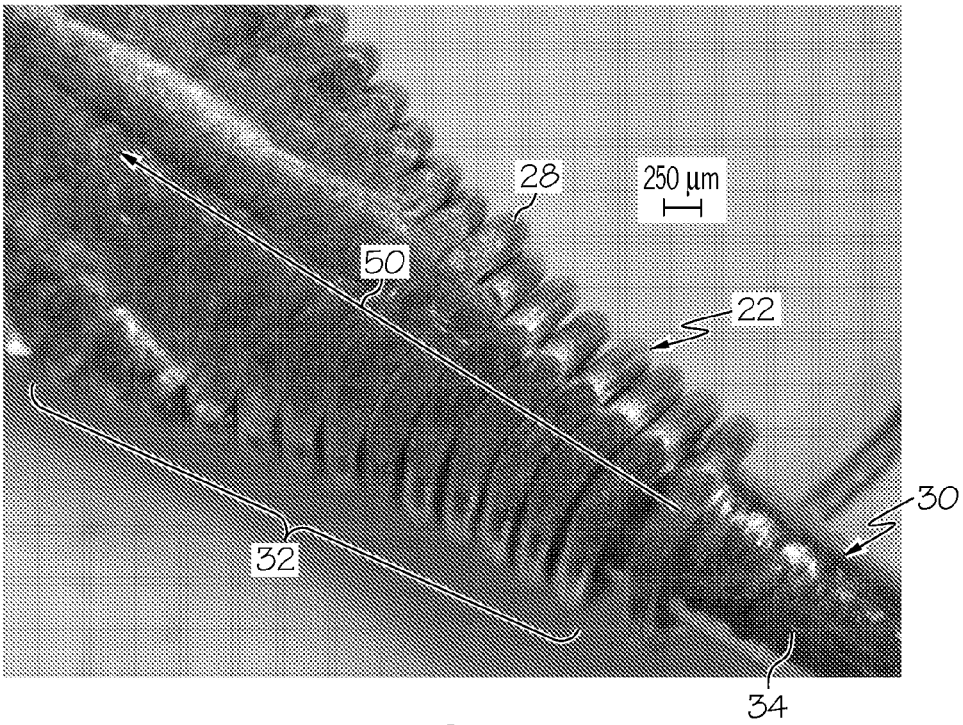
FIG. 4 is a side view of a second exemplary tapered crimp joint utilized to mechanically and electrically interconnect the magnet wire shown in FIG. 1 to a neighboring lead wire.

The foregoing has thus described one exemplary manner in which end portion 28 of coiled magnet wire 22 may be joined to an end portion 34 of lead wire 30 by way of a tapered crimp joint when lead wire 30 assumes the form of a hollow wire braid. While such a structural configuration is generally preferred, lead wire 30 need not assume the form of a hollow wire braid in all embodiments. Instead, in certain embodiments, lead wire 30 may comprise a single, non-braided wire having a diameter larger than that of coiled magnet wire 22. Further illustrating this point, FIG. 4 is a side view illustrating an exemplary manner in which end portion 28 of coiled magnet wire 22 may be joined to end portion 34 of lead wire 30 when lead wire 30 assumes the form of a non-braided, large gauge wire; e.g., lead wire 30 may have a wire gauge of approximately 18 AWG, while coiled magnet wire 22 have approximately 30 AWG. As can be seen in FIG. 4, end portion 28 of magnet wire 22 is repeatedly wrapped or coiled around end portion 34 of lead wire 30, and the resulting structure is crimped to form tapered crimp joint 32. As indicated in FIG. 4 by arrow 50, tapered crimp joint 32 increases gradually in deformation when moving axially along joint 32 and lead wire 30 in a direction away from where magnet wire 22 is initially wound around lead wire 30. As noted above, due to its unique tapered geometry, crimp joint 32 ensures that both an optimal mechanical and an optimal electrical bond are formed at different junctures along the length of crimp joint 32.

Whether assuming a braided or non-braided form, lead wire 30 is preferably fabricated from aluminum or an aluminum-based alloy (collectively referred to as "aluminum"), or from nickel or nickel-based alloy (collectively referred to herein as "nickel"). Relative to other conductive metals and alloys, aluminum provides excellent electrical conductivity, is commercially available at minimal cost, can be oxidized to form an outer insulative shell of alumina, and can be deformed relatively easily during crimping. Furthermore, in preferred embodiments wherein anodized aluminum wire is utilized as the coiled magnet wire, the usage of an aluminum wire for lead wire 30 ensures uniformity in CTE, uniformity in hardness, and metallurgical compatibility (and thus a decreased likelihood of galvanic reactions) across the crimping interface. By comparison, nickel is more costly and has a lower coefficient of thermal expansion than does aluminum. Furthermore, in embodiments wherein coiled magnet wire 22 is produced from aluminum and lead wire 30 is produced from nickel, deformation may be largely concentrated in the softer coiled magnet wire 22. However, as compared to aluminum, nickel has a higher mechanical strength and is less susceptible to work hardening and breakage. A braided or non-braided nickel wire may thus be utilized as lead wire 30 in certain embodiments. The foregoing notwithstanding, lead wire 30 may be fabricated from any metal or alloy that can be crimped to coiled magnet wire 22 (FIGS. 1-3) to form reliable electrical and mechanical bond. For example, other oxidation-resistant metals or alloys can advantageously be employed to fabricate lead wire 30 including, but not limited to, stainless steel, silver, and copper. Depending upon the particular metal or alloy from which lead wire 30 is formed, lead wire 30 can also be plated or clad with various metals or alloys to increase electrical conductivity, to enhance crimping properties, and/or to improve oxidation resistance. A non-exhaustive list of plating materials suitable for this purpose includes nickel, aluminum, gold, palladium, platinum, and silver. As three specific examples, lead wire 30 may be fabricated from silver-plated nickel, silver-plated stainless steel, or nickel-plated copper.

Figure 5:
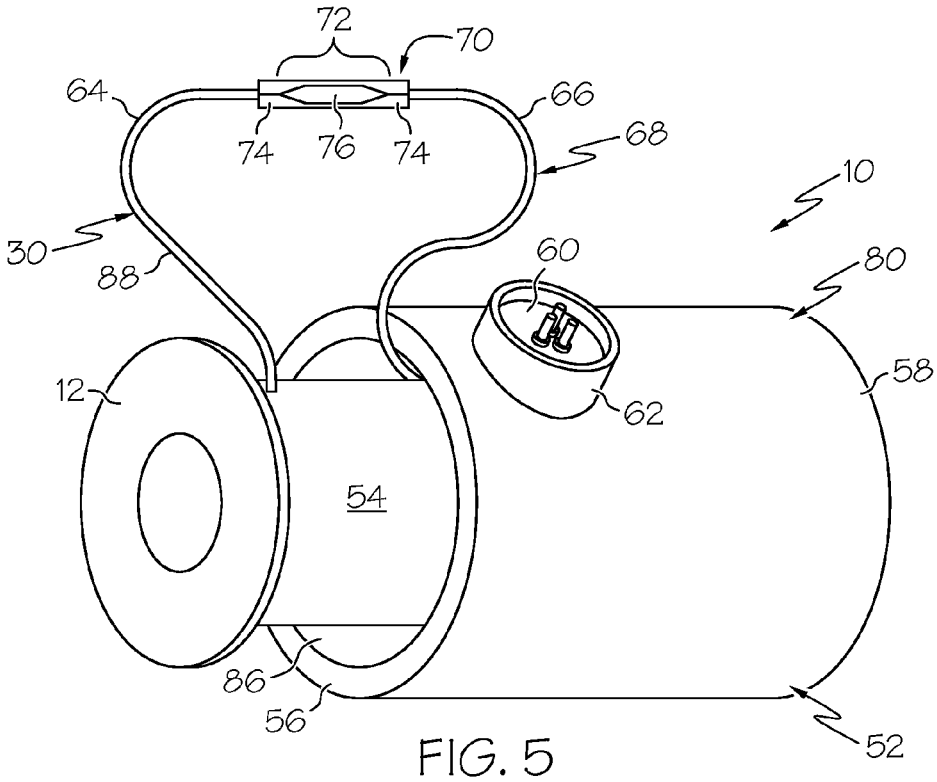
FIG. 5 is an isometric view of the electromagnetic coil assembly shown in FIG. 1 in a partially assembled state and illustrated in accordance with further embodiment of the present invention.

FIG. 5 is an isometric view of electromagnetic coil assembly 10 in a partially-assembled state and illustrated in accordance with an exemplary embodiment of the present invention. In the exemplary embodiment illustrated in FIG. 5, electromagnetic coil assembly 10 further includes a canister 52 into which bobbin 12 and the potted coil 54 are inserted, the term "potted coil" utilized to collectively refer to coiled magnet wire 22 and inorganic dielectric body 24 shown in FIG. 1. Canister 52 assumes the form of a generally tubular casing having an open end 56 and an opposing closed end 58. The cavity of canister 52 may be generally conformal with the geometry and dimensions of bobbin 12 such that, when fully inserted into canister 52, the trailing flange of bobbin 12 effectively plugs or covers open end 56 of canister 52, as described more fully below in conjunction with FIG. 7. At least one feedthrough connector 60 is mounted through a wall of canister 52 to enable electrical connection to potted coil 54 while bridging the hermetically-sealed environment within canister 52. For example, as shown in FIG. 5, feedthrough connector 60 may be mounted within a tubular chimney structure 62, which extends through the annular sidewall of canister 52. Feedthrough connector 60 includes a plurality of conductive terminal pins, which extend through a glass body, a ceramic body, or other insulating structure. In the illustrated example, feedthrough connector 60 includes three pins; however, the number of pins included within the feedthrough assembly, as well as the particular feedthrough assembly design, will vary in conjunction with the number of required electrical connections and other design parameters of electromagnetic coil assembly 10.

It is technically possible to connect the lead wires of electromagnetic coil assembly 10 directly to the pins of feedthrough connector 60 (again, only a single lead wire 30 is shown in the figures for clarity). However, spatial constraints may render the direct connection of the lead wires to the feedthrough connector pins overly difficult. Thus, in certain embodiments, the lead wires may be connected to intervening wires (referred to herein as "feedthrough wires"), which are, in turn, connected to the pins of the feedthrough connector. For example, with reference to FIG. 5, the outer end portion 64 of lead wire 30 may be electrically connected to the neighboring end portion 66 of a feedthrough wire 68; and the opposing end portion of feedthrough wire 68 (hidden from view in FIG. 5) may be electrically connected to a pin of feedthrough connector 60 by, for example, brazing. In preferred embodiments, feedthrough wire 68 assumes the form of a hollow wire braid, which can be inserted over a selected pin of feedthrough connector 60 prior to brazing. Feedthrough wire 68 is conveniently formed from nickel to facilitate brazing to the feedthrough connector pin; however, feedthrough wire 68 is not limited to fabrication from nickel and may be formed from other materials, as well, including aluminum. In one implementation of electromagnetic coil assembly 10, coiled magnet wire 22 comprises anodized aluminum wire, lead wire 30 comprises a braided aluminum cable or tube, and feedthrough wire 68 comprises a nickel cable or tube, which is crimped to lead wire 30 within an aluminum crimp barrel. Testing has shown the foregoing implementation of electromagnetic coil assembly 10 to perform well under high temperature operating conditions and to provide a relatively low contact resistance across crimp joints.

As was the case with coiled magnet wire 22 and end portion 34 of lead wire 30, it is preferred that end portion 64 of lead wire 30 is mechanically and electrically connected to feedthrough wire 68 by way of a tapered crimp joint to ensure the creation of optimal mechanical and electrical bonds along the length of the crimp joint. In embodiments wherein at least one of lead wire 30 or feedthrough wire 68 assumes the form of a non-braided wire, any of the crimp joints described above may be utilized; e.g., if lead wire 30 assumes the form of a non-braided wire and feedthrough wire 68 assumes the form of a braided wire, end portion 64 of lead wire 30 may be inserted into the opening in end portion 66 of feedthrough wire 68, and the resulting structure may be crimped in the manner described above in conjunction with FIG. 2. However, in preferred embodiments wherein lead wire 30 and feedthrough wire 68 both assume the form of a braided wire, a different crimping technique may be utilized. In particular, as shown in FIG. 5, end portion 64 of lead wire 30 and end portion 66 of feedthrough wire 68 may be inserted into a tubular crimp barrel 70, which is then crimped to form a tapered crimp joint 72. As was the case previously, the deformation of crimp joint 72 may gradually increase toward the center portion of joint 72 such that joint 72 has a substantially hourglass-shaped profile, when viewed from a side of the tapered crimp joint. Stated differently, opposing end portions 74 of crimp barrel 70 may be left uncrimped or only slightly crimped, while intermediate portion 76 of crimp barrel 70 may be crimped most heavily. Crimping of crimp barrel 70 may be performed utilizing a crimping tool similar to that shown in FIG. 3. Crimp barrel 70 is preferably, although not necessarily, fabricated from aluminum tubing. Although illustrated as inserted into opposing ends 74 of crimp barrel 70 in FIG. 5, lead wire 30 and feedthrough wire 68 may be inserted into the same end of crimp barrel 70 in alternative embodiments, in which case the non-wire-receiving end of crimp barrel 70 may be trimmed after crimping.

Figure 6:
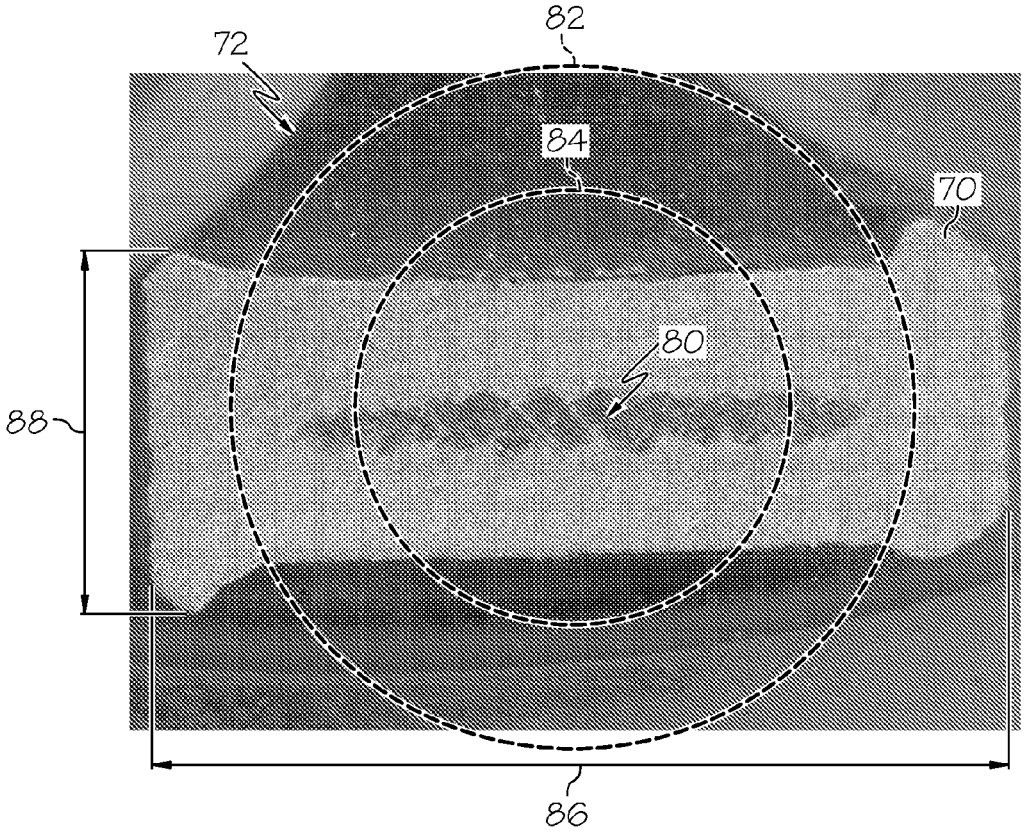
FIG. 6 is a cross-sectional view taken through the exemplary tapered crimp joint shown in FIG. 5 mechanically and electrically connected the illustrated lead wire to the illustrated feedthrough wire.

FIG. 6 is a cross-sectional view taken through a central portion of tapered crimp joint 72 shown in FIG. 5 provided to better illustrate the deformation of lead wire 40, feedthrough wire 68, and crimp barrel 70 induced by crimping. In this example, lead wire 40 and feedthrough wire 68 each assume the form of a braided wire and collectively form core region 80 of crimp joint 72. The original outer diameter and inner of crimp barrel 70 is represented in FIG. 6 by dashed circles 82 and 84, respectively. By way of non-limiting example, the original outer and inner diameters of crimp barrel 70 may be approximately 0.125 and approximately 0.075 inch, respectively. After crimping, the most deformed region of crimp barrel 70, and thus of crimp joint 72, may have a width of approximately 0.125 inch (represented in FIG. 6 by double headed arrow 86) and a thickness of approximately 0.075 inch (represented in FIG. 6 by double headed arrow 88).

While, in the illustrated exemplary embodiment shown in FIGS. 5 and 6, two wires (feedthrough wire 68 and lead wire 40) are inserted into a single crimp barrel (crimp barrel 70), which is then crimped to form the desired metallurgical and electrical connections, it should readily be appreciated that three or more wires can also be joined in a similar manner. In this case, the dimensions of the crimp barrel may be increased, as appropriate, to accommodate the multitude of wires. In addition, any given wire or lead can extend through a series of crimp barrels to enable the wire to be mechanically and electrically connected to multiple additional wires.

Figure 7:
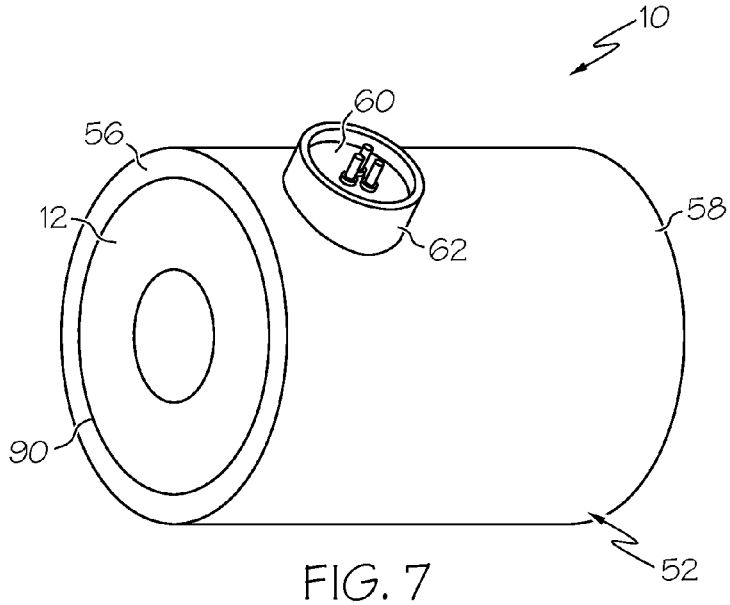
FIG. 7 is isometric views of the electromagnetic coil assembly shown in FIG. 5 in a fully assembled state.

FIG. 7 is an isometric view of electromagnetic coil assembly 10 in a fully assembled state. As can be seen, bobbin 12 and potted coil 54 (identified in FIG. 5) have been fully inserted into canister 52 such that the trailing flange of bobbin 12 has effectively plugged or covered open end 56 of canister 52. In certain embodiments, the empty space within canister 54 may be filled or potted after insertion of bobbin 12 and potted coil 54 (FIG. 5) with a suitable potting material. Suitable potting materials include, but are by no means limited to, high temperature silicone sealants (e.g., ceramic silicones), inorganic cements of the type described above, and ceramic powders (e.g., alumina or zirconia powders). In the case wherein potted coil 54 is further potted within canister 52 utilizing a powder or other such filler material, vibration may be utilized to complete filling of any voids present in the canister with the powder filler. In certain embodiments, potted coil 54 may be inserted into canister 52, the free space within canister 52 may then be filled with a potting powder or powders, and then a small amount of dilute cement may be added to loosely bind the powder within canister 52.

With continued reference to the exemplary embodiment shown in FIG. 7, a circumferential weld or seal 90 has been formed along the annular interface defined by the trailing flange of bobbin 12 and open end 56 of canister 52 to hermetically seal canister 52 and thus complete assembly of electromagnetic coil assembly 10. Electromagnetic coil assembly 10 may then be integrated into a coiled-wire device. In the illustrated example wherein electromagnetic coil assembly 10 includes a single wire coil, assembly 10 may be included within a solenoid. In alternative embodiments wherein electromagnetic coil assembly 10 is fabricated to include primary and secondary wire coils, assembly 10 may be integrated into a linear variable differential transducer or other sensor. Due at least in part to the inorganic composition of potted dielectric body 24, electromagnetic coil assembly 10 is well-suited for usage within avionic applications and other high temperature applications. Notably, in certain embodiments wherein coiled magnet wire 22 is produced utilizing aluminum wire, the operating temperature of electromagnetic coil assembly 10 may approach or exceed the annealing temperature of the aluminum wire, which reduces mechanical stressors induced by the above-described crimping process. As noted above, curing of the inorganic insulative material may also entail exposing electromagnetic coil assembly 10 to temperatures exceeding the annealing temperature of the chosen anodized aluminum wire to further alleviate mechanical stress within the crimp joints to thereby decrease the likelihood of post-crimping flow of the aluminum urged by compressive forces within the crimp joints, which could otherwise negatively impact the integrity of the crimp joints over time.

In the above-described exemplary embodiments, the tapered crimp joints formed between the magnet wire coils and the lead wires were buried or embedded within an inorganic insulative medium or body. Any asymmetries that may occur as a result of this structural configuration (i.e., excessive lopsidedness of the coil from center to edge) may be minimized or eliminated by winding a complete layer of lead wire over the magnet wire. This, however, may have the undesirable effect of increasing the overall dimensions of the electromagnetic coil assembly and the probability of electrical shorting between the lead wire and magnet wire. Thus, as an alternative manner in which to alleviate or reduce asymmetries in the electromagnetic coil assembly, the length of the lead wire may be extended past the crimp joint in the region attached/adjacent to the crimped region to bring the total length of the crimped in combination with the extra lead section into substantial equivalency with the width of the coil. The extra lead length can then be flattened from the crimp joint, and laid flat across the width of the coil core, as described below in conjunction with FIGS. 8-12. Alternatively, the extra lead length can be wound around the wire coil in a gradual manner to minimize bending, stress, and pull-out forces applied to the magnet wire end, as described more fully below in conjunction with FIG. 13.

Figure 8:
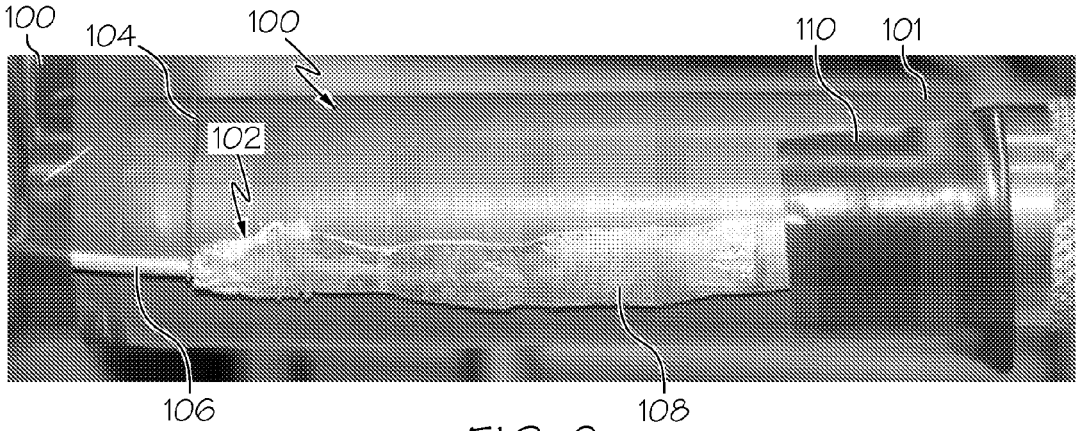
FIGS. 8-12 illustrate a second exemplary electromagnetic coil assembly at various stages of production.

FIGS. 8-12 illustrate a second exemplary electromagnetic coil assembly 100 at various stages of production. Referring initially to FIG. 8, a tapered crimped connection 102 is formed between a magnet wire 104 and a lead wire 106, which is placed against a tubular support 101 (e.g., a bobbin) inserted over the rotating shaft wire winding machine. In this example, lead wire 106 assumes the form of a single, non-braided, large gauge wire; e.g., the diameter of lead wire 106 may be approximately 1.0 millimeter, although smaller diameter wires may be utilized to minimize the application of undesirable prying forces to coil assembly 100 that could potentially cause structural damage. For comparison, magnet wire 104 may be approximately 30 AWG. As indicated in FIG. 8 at 108, lead wire 106 may extend across the full length of the coil, magnet wire 104 may be wound around the length of lead wire 106, and the resulting structure may be flattened. Tape 110 is conveniently utilized to secure lead wire 106 in a desired position prior to the winding process. Although not shown in FIG. 8, a dielectric layer (e.g., a ceramic cloth, a fiberglass fabric, fiberglass or ceramic thread, ceramic felt, or paper) may then be wrapped around tubular support 101 and over the flattened portion of lead wire 106 and magnet wire 104 to further reduce the probability of a short developing between the flattened lead wire and the first wound coil layer. Advantageously, the flattened lead wire has a relatively low profile and is only slightly distorted. In addition, the orientation of the lead wire allows the slight distortion to be distributed uniformly across the width of the coil. In a further embodiments, lead wire 106 may assume the form of a flat wire braid.

Figure 9:
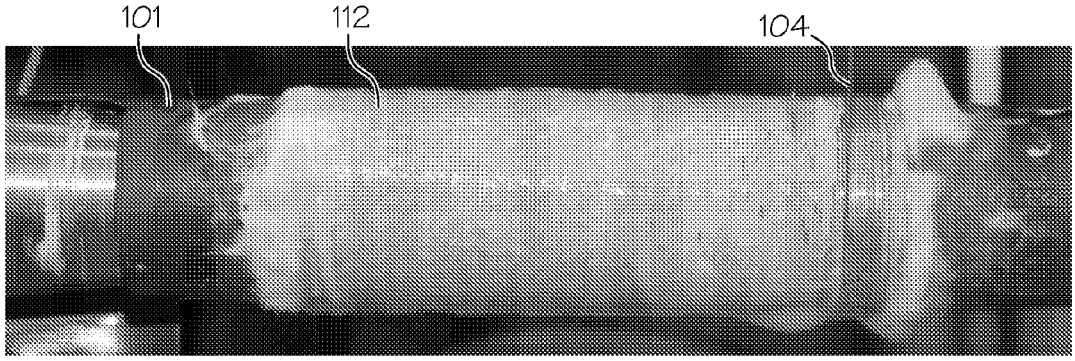
Figure 10:
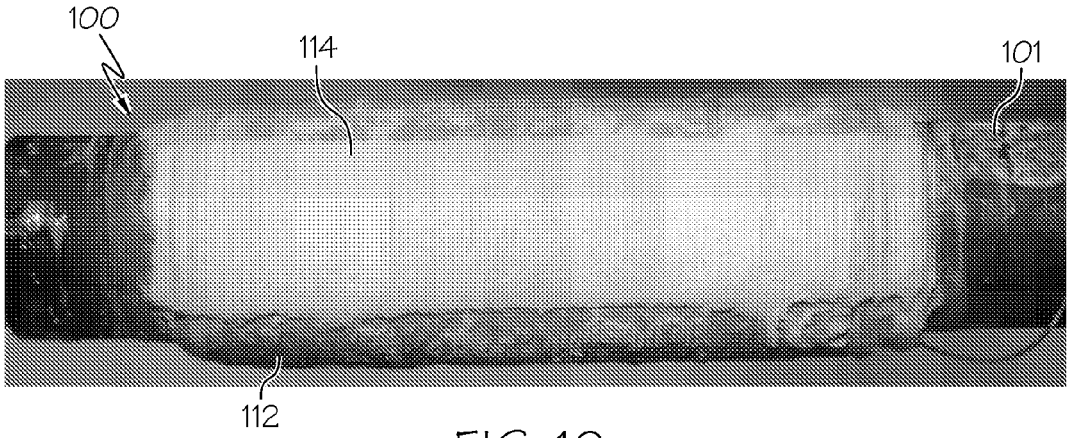
Figure 11:
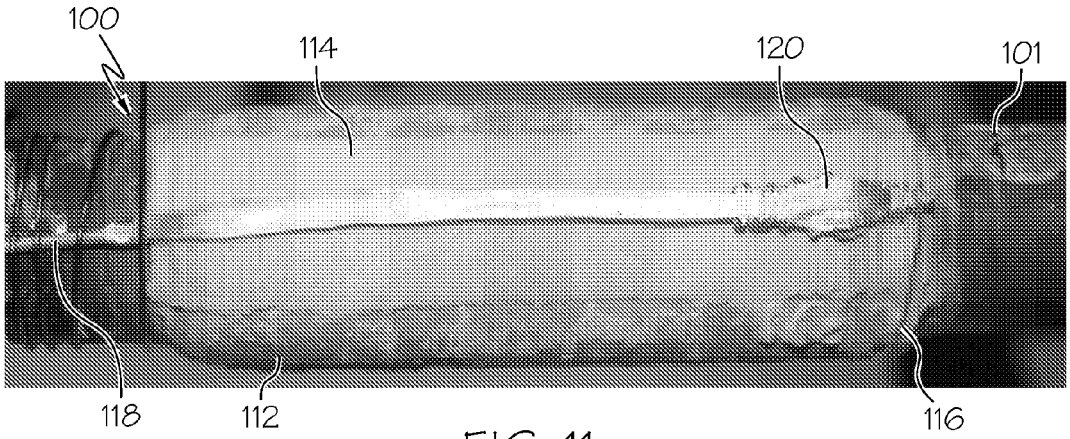
Figure 12:
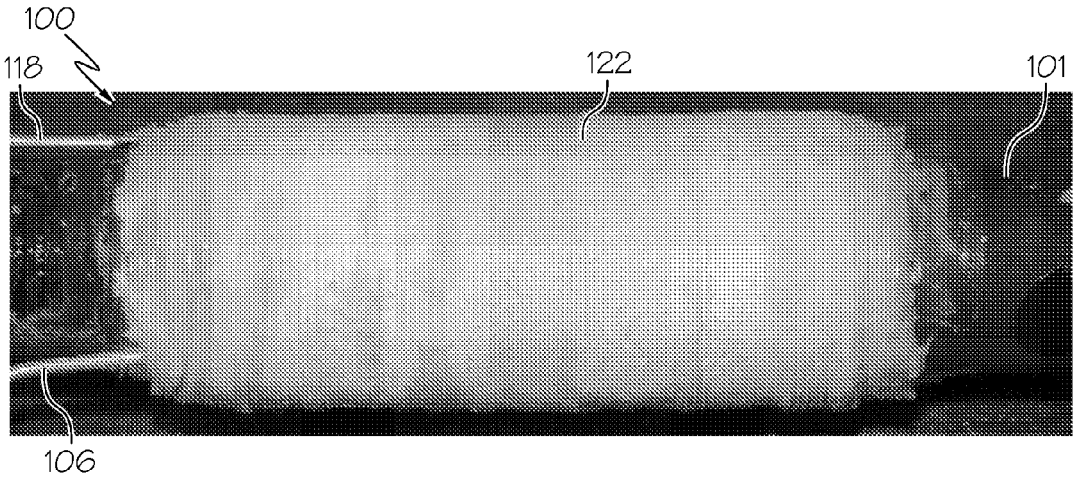

With reference to FIG. 9, magnet wire 104 is next wet wound around tubular support 101 to form an electromagnetic coil enveloped by a green state inorganic dielectric material of the type described above (e.g., an inorganic cement). After winding, magnet wire 104 may include, for example, multiple layers each consisting of several hundred windings. The green state inorganic dielectric material is then dried and cured at an elevated temperature to form an electrically-insulative dielectric body or medium 112 in which coiled magnet wire 104 is embedded. After curing, a second dielectric layer 114 (e.g., a second pre-soaked strip of ceramic cloth) is laid across the potted coil and compressed by, for example, the formation of addition windings, as shown in FIG. 10. The outer, exposed end 116 of the magnet wire coil may then be joined to a second lead wire 118 by formation of a second tapered crimp joint 120 of the type described above (shown in FIG. 11). Crimp joint 120 may be flattened and laid across the strip of ceramic cloth. Lastly, a further dielectric layer may be formed (e.g., another ceramic cloth pre-soaked with cement) may be wrapped around the potted coil and the crimp joint and one or more additional wire coil 122 may be formed utilizing a wet-winding process, as shown in FIG. 12.

Figure 13:
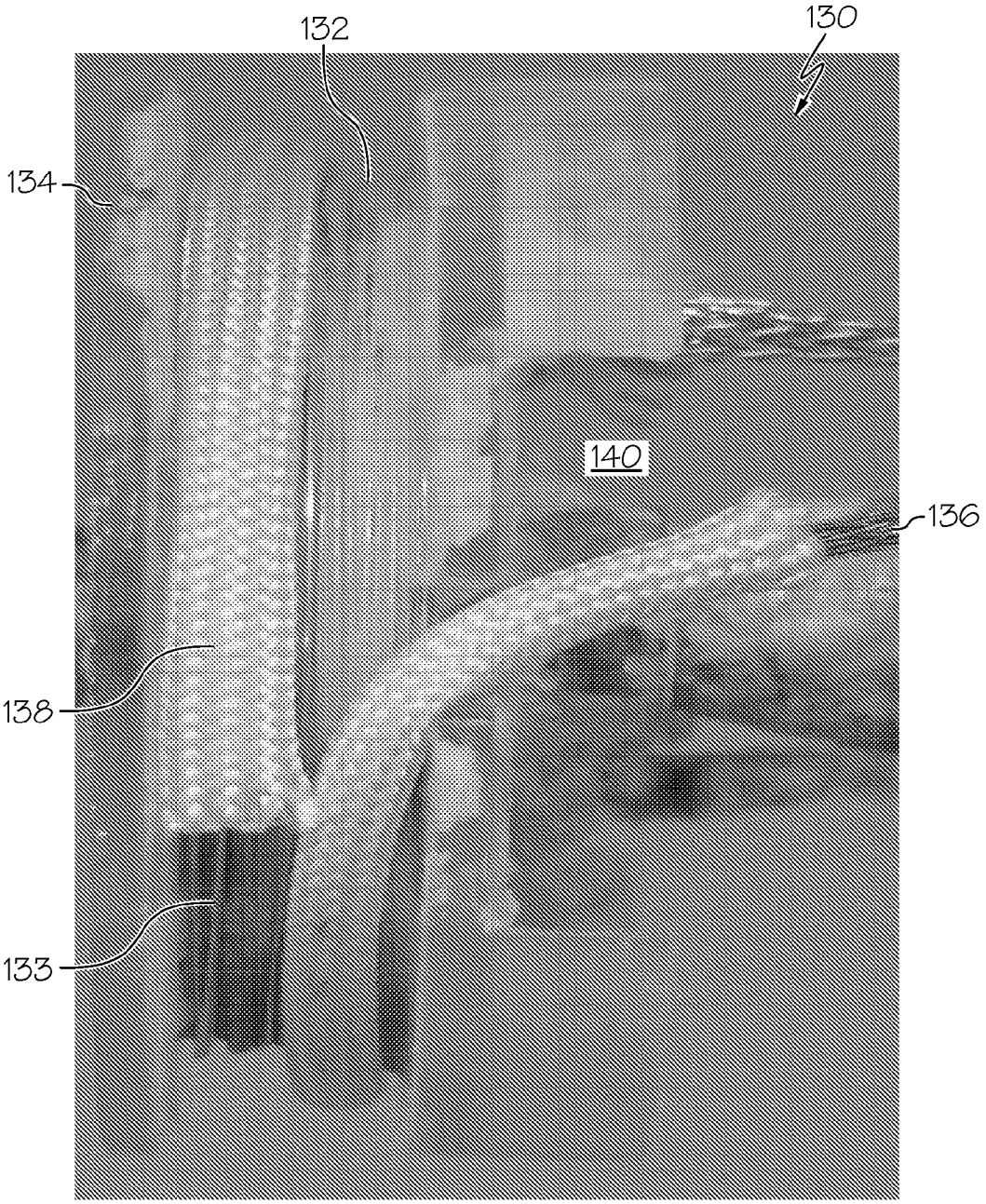
FIG. 13 illustrates an exemplary electromagnetic coil assembly in accordance with a still further exemplary embodiment of the present invention.

In the exemplary embodiment described above in conjunction with FIGS. 8-12, the lead wire was pressed flat against the coil body and extended across the coiled body along a substantially linear path. While this is acceptable in many embodiments, it may be desirable to gently wrap the lead wire around the coil body in a spiral configuration to minimize bending forces and pull-out forces applied to the magnet wire at the crimp joint interface, especially when the magnet wire is fabricated from aluminum. Further illustrates this point, FIG. 13 depicts an electromagnetic coil assembly 130 including a coiled magnet wire 132 embedded in an inorganic dielectric material (e.g., cement) and wound around a tubular support structure or spool 134. Terminal end 133 of magnet wire 132 extends from the inorganic dielectric material and is joined to a neighboring terminal end of braided lead wire 136 by way of a tapered crimp joint (hidden from view in FIG. 13). Electromagnetic coil assembly 130 may further include additional tapered crimp joints, which are embedded within the inorganic dielectric material and thus also hidden from view in FIG. 13. An electrically-insulative sleeve 138 (e.g., a ceramic or fiberglass fibers woven into a jacket) is disposed over braided lead wire 136, and sleeve 138 and braided lead wire 136 are wrapped around coiled magnet wire 132; e.g., as shown in FIG. 13, sleeve 138 and braided lead wire 136 may extend across the width of spool 134 while following a loose spiral path and making one complete turn before exiting spool 134 through a slot or opening 140. In this manner, the application of excessive bending or pulling forces on magnet wire 132 is avoided while the overall symmetry of electromagnetic coil assembly 130 is preserved.

The foregoing has thus provided embodiments of an electromagnetic coil assembly suitable for usage within high temperature coiled-wire devices (e.g., solenoids, linear variable differential transformers, and three wire position sensors, to list but a few) wherein mechanical stress and work hardening of magnet wire is reliably avoided during manufacture. In particular, a fine gauge magnet wire, such as a fine gauge anodized aluminum wire, is bonded to a larger diameter wire or a weave or braid of several conductors to alleviate issues associated with work hardening leading that may otherwise result in breakage or resistance hot spot failure. In preferred embodiments, a tapered crimp joint is utilized to join each end of the magnet wire to a corresponding lead wire and thereby provide both an optimal mechanical and electrical connection between the wires. Furthermore, the tapered crimp joint may be buried or embedded within an inorganic electrically-insulative body to mechanical isolate the fine gauge magnet wire from bending forces occurring during production and assembly of the electromagnetic coil assembly. Embodiments of the electromagnetic coil assembly described above are capable of providing prolonged and reliable operation in high temperature environments characterized by temperatures exceeding approximately 400° C.; furthermore, in cases wherein materials other than anodized aluminum are utilized to form the magnet wire coil or coils, embodiments of the electromagnetic coil assembly may reliably operate in high temperature environments characterized by temperatures approaching or exceeding approximately 538° C. As a further advantage, embodiments of the above-described electromagnet coil assembly are relatively insensitive to radiation due, at least in part, to potting of the electromagnetic coil or coils in an inorganic insulative medium of the type described above; as a result, embodiments of the above-described electromagnetic coil assembly are generally well-suited for usage within nuclear applications.

While multiple exemplary embodiments have been presented in the foregoing Detailed Description, it should be appreciated that a vast number of variations exist. It should also be appreciated that the exemplary embodiment or exemplary embodiments are only examples, and are not intended to limit the scope, applicability, or configuration of the invention in any way. Rather, the foregoing Detailed Description will provide those skilled in the art with a convenient road map for implementing an exemplary embodiment of the invention. It being understood that various changes may be made in the function and arrangement of elements described in an exemplary embodiment without departing from the scope of the invention as set-forth in the appended claims.

What is claimed is:

1. An electromagnetic coil assembly, comprising:
- a coiled magnet wire;
- an inorganic electrically-insulative body encapsulating at least a portion of the coiled magnet wire;
- a lead wire extending into the inorganic electrically-insulative body to the coiled magnet wire; and
- a first tapered crimp joint embedded within the inorganic electrically-insulative body, the first tapered crimp joint mechanically and electrically connecting the lead wire to the coiled magnet wire.

2. An electromagnetic coil assembly according to claim 1 wherein the lead wire comprises a hollow wire braid.

3. An electromagnetic coil assembly according to claim 2 wherein an end portion of the coiled magnet wire is inserted into an end portion of the hollow wire braid.

4. An electromagnetic coil assembly according to claim 1 wherein the coiled magnet wire comprises anodized aluminum wire.

5. An electromagnetic coil assembly according to claim 1 wherein the first tapered crimp joint increases in deformation when moving from either end of the first tapered crimp joint inward toward a central portion thereof.

6. An electromagnetic coil assembly according to claim 5 wherein the first tapered crimp joint has a substantially hourglass-shaped geometry, when viewed from a side of the tapered crimp joint.

7. An electromagnetic coil assembly according to claim 1 further comprising:
- a hermetically-sealed housing; and
- a feedthrough connector extending through a wall of the hermetically-sealed housing, the lead wire electrically coupled to the feedthrough.

8. An electromagnetic coil assembly according to claim 7 further comprising:
- a feedthrough wire coupled between the lead wire and the feedthrough connector; and
- a second tapered crimp joint mechanically and electrically connecting the feedthrough wire and the lead wire.

9. An electromagnetic coil assembly according to claim 8 wherein the second tapered crimp joint comprises a crimp barrel compressed over an end portion of the feedthrough wire and a neighboring end portion of the lead wire.

10. An electromagnetic coil assembly according to claim 9 wherein the feedthrough wire comprises a braided feedthrough wire.

11. An electromagnetic coil assembly according to claim 10 wherein the feedthrough comprises a pin, and wherein an end portion of the braided feedthrough wire is inserted over the pin and mechanically affixed thereto by brazing.

12. An electromagnetic coil assembly, comprising:
- a braided lead wire;
- a coiled magnet wire;
- an inorganic electrically-insulative body encapsulating the coiled magnet wire; and
- a first crimp joint mechanically and electrically connecting the braided lead wire to the coiled magnet wire, the first crimp joint embedded within the inorganic electrically-insulative body.

13. An electromagnetic coil assembly according to claim 12 wherein the deformation of the first crimp joint increases gradually when moving axially along the length of the crimp joint.

14. An electromagnetic coil assembly according to claim 12 wherein the coiled magnet wire comprises anodized aluminum wire.

15. An electromagnetic coil assembly according to claim 12 further comprising:
- a hermetically-sealed housing; and
- a feedthrough connector extending through a wall of the hermetically-sealed housing, the lead wire electrically coupled to the feedthrough.

16. An electromagnetic coil assembly according to claim 15 further comprising:
- a feedthrough wire coupled between the lead wire and the feedthrough connector; and
- a second tapered crimp joint mechanically and electrically connecting the feedthrough wire and the lead wire.

17. An electromagnetic coil assembly according to claim 16 wherein the second tapered crimp joint comprises a crimp barrel compressed over an end portion of the feedthrough wire and a neighboring end portion of the lead wire.

18. An electromagnetic coil assembly according to claim 17 wherein the feedthrough wire comprises a braided feedthrough wire.

* * * * *